US008783369B2

(12) United States Patent
Rioufol

(10) Patent No.: US 8,783,369 B2
(45) Date of Patent: Jul. 22, 2014

(54) DOWNHOLE PRESSURE BARRIER AND METHOD FOR COMMUNICATION LINES

(75) Inventor: Emmanuel Rioufol, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/696,956

(22) Filed: Jan. 29, 2010

(65) Prior Publication Data

US 2010/0193200 A1 Aug. 5, 2010

Related U.S. Application Data

(60) Provisional application No. 61/148,642, filed on Jan. 30, 2009.

(51) Int. Cl.
*E21B 33/16* (2006.01)

(52) U.S. Cl.
USPC ..... 166/387; 166/285; 166/65.1; 166/66; 166/183

(58) Field of Classification Search
USPC ..... 166/285, 387, 65.1, 66, 183, 192
See application file for complete search history.

(56) References Cited

U.S. PATENT DOCUMENTS 3,378,069 A 4/1968 Fields
3,387,658 A 6/1968 LeBourg
3,387,659 A 6/1968 Current
3,387,660 A 6/1968 Berryman
3,412,800 A 11/1968 Kisling
3,460,624 A 8/1969 Aitken et al.
3,460,625 A 8/1969 Hart et al.
3,630,078 A 12/1971 Bonnet
RE28,464 E 7/1975 Bonnet
4,627,490 A 12/1986 Moore
4,775,009 A * 10/1988 Wittrisch et al. ..... 166/250.11
5,297,943 A 3/1994 Martin
6,302,203 B1 10/2001 Rayssiguier et al.
6,369,718 B1 4/2002 Mathieu
6,437,326 B1 8/2002 Yamate et al.
6,675,901 B2 1/2004 Johnson et al.
6,679,334 B2 1/2004 Johnson et al.
6,772,836 B2 8/2004 Schetky et al.
6,837,310 B2 1/2005 Martin
7,000,697 B2 2/2006 Goode et al.
7,040,402 B2 5/2006 Vercaemer
7,059,428 B2 6/2006 Frey et al.
7,071,696 B2 * 7/2006 Gambier et al. ..... 324/347
7,380,597 B2 6/2008 Edwards et al.

(Continued)

OTHER PUBLICATIONS

Examination Report dated May 7, 2013 for GB Application No. GB1114171.0 (3 pages).

*Primary Examiner* — Nicole Coy
(74) *Attorney, Agent, or Firm* — David J. Groesbeck; Brandon S. Clark

(57) ABSTRACT

A technique enables sealing of downhole components by providing a downhole pressure barrier for communication lines. The system comprises a communication line cementing sub that may be coupled into a tubing string. The cementing sub comprises a flow passage, a radially protruding region, a first connector, and a second connector. The first connector is generally disposed on a first longitudinal end of the radially protruding region, and the second connector is disposed on a second longitudinal end of the radially protruding region. Additionally, a passageway extends through the radially protruding region from the first connector to the second connector. The first and second connectors enable routing of a communication line through the radially protruding region.

19 Claims, 3 Drawing Sheets

(56) References Cited

U.S. PATENT DOCUMENTS

| | | | | |
|---|---|---|---|---|
| 2002/0112540 | A1 | 8/2002 | Zeroug et al. | |
| 2003/0058127 | A1 | 3/2003 | Babour et al. | |
| 2005/0087368 | A1 | 4/2005 | Boyle et al. | |
| 2007/0227727 | A1 | 10/2007 | Patel et al. | |
| 2007/0277979 | A1* | 12/2007 | Todd et al. | 166/287 |
| 2008/0311776 | A1 | 12/2008 | Cox et al. | |
| 2009/0006005 | A1 | 1/2009 | Segal et al. | |
| 2009/0038849 | A1 | 2/2009 | Braden et al. | |
| 2009/0101363 | A1 | 4/2009 | Teixeira | |
| 2009/0166087 | A1 | 7/2009 | Braden | |

* cited by examiner

DOWNHOLE PRESSURE BARRIER AND METHOD FOR COMMUNICATION LINES

CROSS-REFERENCE TO RELATED APPLICATION

The present document is based on and claims priority to U.S. Provisional Application Ser. No. 61/148,642, filed 30 Jan., 2009, the contents of which are herein incorporated by reference in their entirety.

BACKGROUND

The following descriptions and examples are not admitted to be prior art by virtue of their inclusion in this section.

Hydrocarbon fluids, such as oil and natural gas, are obtained from a subterranean geologic formation, referred to as a reservoir, by drilling a well that penetrates the hydrocarbon-bearing formation. To optimize production of desired fluids from the hydrocarbon-bearing formation, well completion systems are installed to monitor downhole conditions and to manipulate and/or communicate with various components. The well completion systems comprise instrumentation and control lines to facilitate the monitoring of and control over the various well components. However, the conditions downhole present many challenges to successfully completing and communicating with well system components. Typically, the wellbore presents a high pressure environment coupled with a caustic and corrosive chemical mix that attacks components and continually seeks pathways for migration.

The potential problem of unwanted migration of fluids continues in the case of a plugged and cemented well. The presence of downhole instrumentation cables and/or other communication lines can increase the risk of fluid migrating up the wellbore and past the cement plugs by providing a potential migration pathway along the communication lines. The fluid migration may take at least two forms: fluid migration outside the cable, and fluid migration inside the cable. Regarding fluid migration outside the cable, insufficient fluid removal around the cable during the cementing process may establish a preferred path for fluid leakage. Furthermore, damage to the cable below the plug can result in fluid entering into and migrating along the interior of the cable. A system is needed to help ensure the integrity of a communication line, e.g. cable or conduit, with respect to a surrounding cement plug.

SUMMARY

In general, the present disclosure provides a technique for sealing downhole components by, for example, providing a downhole pressure barrier for communication lines, such as cables. The system comprises a communication line cementing sub that may be coupled into a tubing string. The cementing sub comprises a flow passage, a radially protruding region, a first connector, and a second connector. The first connector is generally disposed on a first longitudinal end of the radially protruding region, and the second connector is disposed on a second longitudinal end of the radially protruding region. Additionally, a passageway extends through the radially protruding region from the first connector to the second connector.

Other or alternative features will become apparent from the following description, from the drawings, and from the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of embodiments of the present disclosure. However, it will be understood by those of ordinary skill in the art that embodiments of the present disclosure may be practiced without these details and that numerous variations or modifications from the described embodiments may be possible. In the specification and appended claims: the terms "connect", "connection", "connected", "in connection with", "connecting", "couple", "coupled", "coupled with", and "coupling" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Embodiments of the present disclosure generally relate to sealing downhole components and providing a downhole pressure barrier for communication lines, such as control cables and conduits. The system and methodology are employed to enclose one or more sections of communication line, e.g., cable, within a cementing sub in order to help inhibit or eliminate formation of a potential migration path along the one or more communication lines when the wellbore is cemented, e.g. plugged, in the area of the cementing sub. By securing the one or more communication lines in a cementing sub in the area to ultimately be plugged, greater security is provided for the wellbore when, for example, the well is abandoned with tubing left in place within the wellbore.

Figure 1:
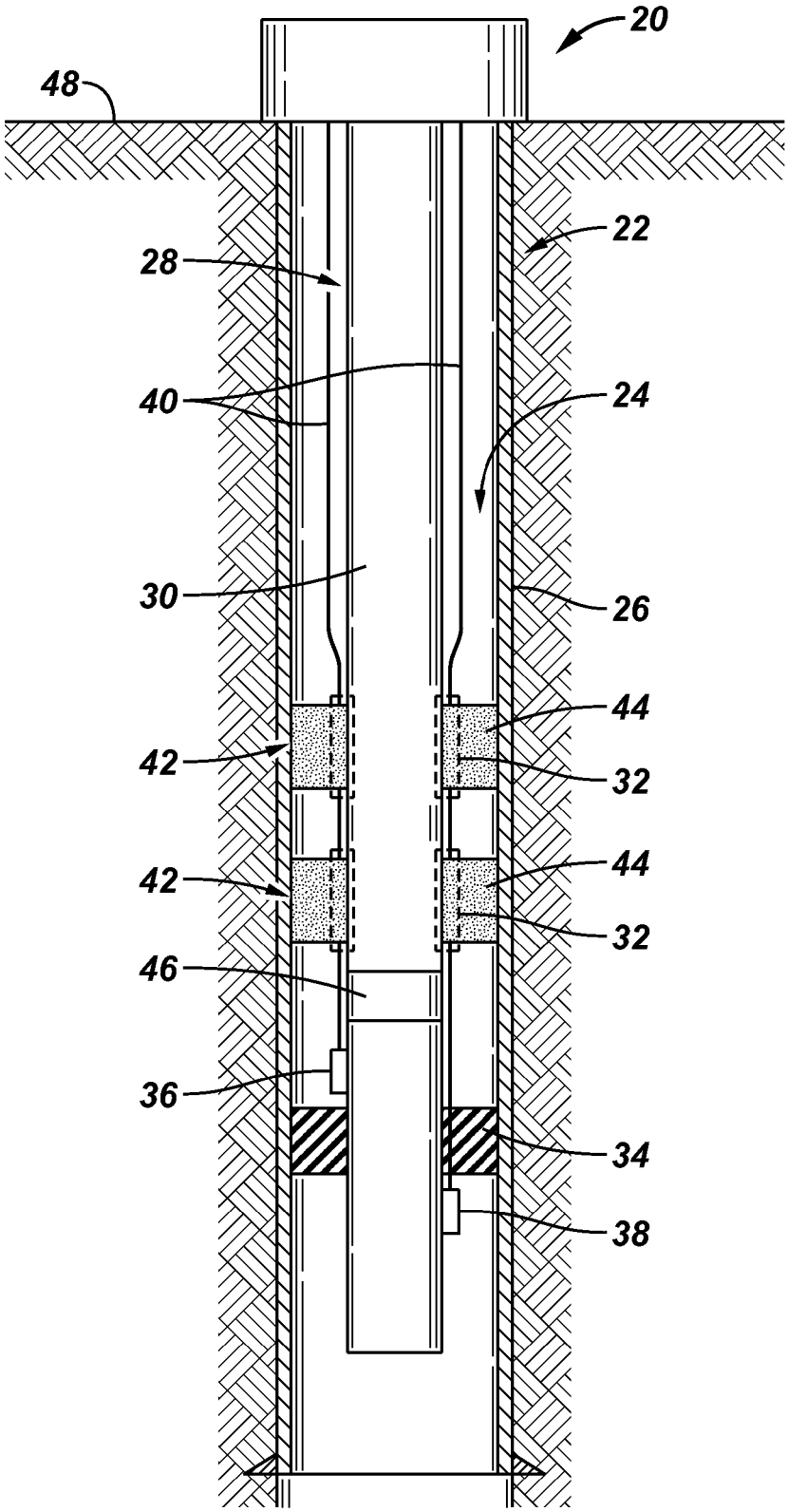
FIG. 1 is a schematic illustration of a well with a tubing string left in place after being cemented and plugged, according to an embodiment of the present disclosure.

Referring generally to FIG. 1, a well system 20 is illustrated, according to one embodiment of the present disclosure. In the example illustrated, a well 22 comprises a wellbore 24 which may be lined with a casing 26. A tubing string 28 is deployed within the wellbore 24 and may comprise, for example, tubing 30, e.g. production tubing, and one or more communication line cementing subs 32. In the specific example illustrated, the well system 20 comprises a pair of cementing subs 32, although individual cementing subs or a greater number of cementing subs may be deployed in the tubing string 28 depending on the specific application. It also should be noted that the illustrated wellbore 24 is a generally vertical wellbore, however the system and methodology also may be utilized in deviated, e.g. horizontal, wellbores.

In the example illustrated, the tubing 30 is sealed with respect to an interior surface of the surrounding casing 26 via a packer 34. An upper permanent gauge 36 is disposed above packer 34 and a lower permanent gauge 38 is disposed below packer 34. The permanent gauges 36, 38 are connected by communication lines 40 which may comprise electrical cables. In other applications, however, the communication lines 40 may comprise conduits, optical fibers, or combinations of signal carrying lines.

The communication lines 40 are routed down through an interior of the cementing subs 32 which are located in well zones 42 that have been selected for cementing. For example, upon abandonment of well 22, cement may be delivered downhole to well zones 42 to form cement plugs 44 surrounding the communication line cementing subs 32, although cement plugs 44 also may be formed within the cementing subs 32. The cement plugs 44 block any further flow along the wellbore annulus between tubing string 28 and the surrounding casing 26. The cementing subs 32 further ensure that no migration of fluid occurs along the communication lines 40. In some applications, the cement, in the form of the cement plugs 44, allows tubing 30 to be left in place within casing 26 after the well is abandoned.

In the specific embodiment illustrated, tubing string 28 further comprises a circulating sub 46. Circulating sub 46 is disposed between the lowest cementing sub 32 and packer 34 and is a single example of the variety of additional components that may be incorporated into the tubing string 28 depending on the specific well application for which it is designed. Similarly, the number and arrangement of packers, cementing subs, communication lines and other components can vary substantially depending on the type of well completion in which they are employed and on the type of well application for which the well system is designed.

For example, some tubing strings may comprise completion systems having instrumentation in the form of gauges to monitor various characteristics of a well system. Examples of such gauges include temperature gauges, pressure gauges, water cut gauges, flow gauges, resistivity gauges, and other types of gauges. The instrumentation, e.g. gauges 36, 38, may be removable or permanent. In the illustrated example, communication lines 40 are cables which extend downhole from a surface 48 to the downhole instrumentation. The cables 40 may be routed with one cable per gauge 36, 38 or one cable per set of gauges. In this example, the cables 40 may provide communication and/or power between the individual gauges 36, 38 as well as between selected gauges and a separate monitoring device, positioned either downhole or established at the surface 48. In addition, the cables 40 may comprise electric lines, fiber optic lines, hydraulic lines, or other appropriate signal carriers designed to facilitate communication between the downhole instrumentation, e.g. gauges 36, 38, and other points of interest.

In an embodiment such as the embodiment illustrated in FIG. 1, the instrumentation may comprise an upper or first set of permanent gauges 36 and a lower or second set of permanent gauges 38. Each of the permanent gauges may be coupled to the surface 48 via a respective cable 40. Accordingly, a plurality of cables, e.g. two cables, is illustrated as routed downhole to the instrumentation. In this example, two downhole cement plugs 44 are illustrated as engaging the cementing subs 32 and the surrounding casing 26. In many applications, the cement plugs 44 are deployed after the well is abandoned and may be positioned around and within each cementing sub 32. The two plugs of cement 44 and the two cables 40 create four zones susceptible to fluid migration if it were not for incorporation of the cementing subs 32 into tubing string 28.

Figure 2:
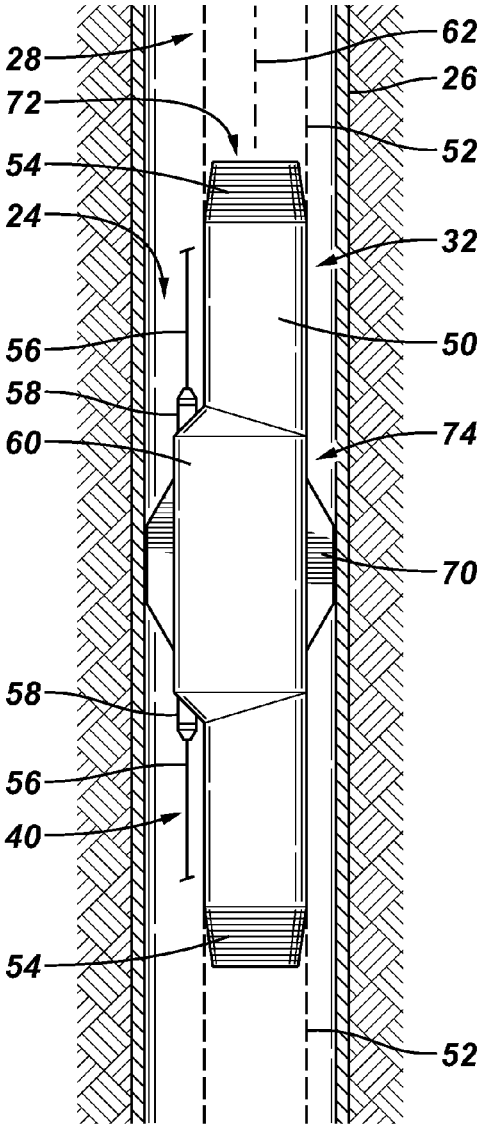
FIG. 2 is a side elevation view of one example of a cementing sub, according to an embodiment of the present disclosure.

In FIG. 2, a more detailed example of one embodiment of a communication line cementing sub 32 is illustrated. In this example, the cementing sub 32 comprises a tubular mandrel 50 which may be coupled into the completion tubing string 28. By way of example, the cementing sub 32 may be connected between adjacent tubing string components 52 by a suitable coupling mechanism 54, such as a threaded coupler designed to enable threaded engagement between the cementing sub 32 and the adjacent tubing string components 52.

Figure 3:
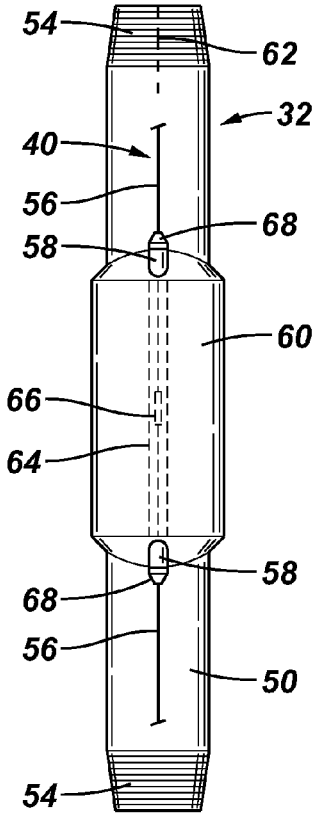
FIG. 3 is a front elevation view of one example of a cementing sub, according to an embodiment of the present disclosure.

As illustrated in both FIGS. 2 and 3, communication line/cable segments 56 of the illustrated communication line 40 may be coupled to the cementing sub 32 via connectors 58 mounted on a radially protruding region 60 of cementing sub 32. Connectors 58 may be positioned on opposite longitudinal ends of radially protruding region 60, as illustrated. The radially protruding region 60 may be offset or eccentric with respect to an axis 62 of the tubing string 28. However, the radially protruding region 60 is not limited to the eccentric geometry and, depending on the application, may have an arcuate configuration or other configurations suitable for incorporation with other completion components. In some embodiments, the radially protruding region 60 may comprise upper and lower protrusions for coupling to respective upper and lower cable segments 56, while the area between the upper and lower protrusions retains a relatively reduced diameter. In some embodiments, a concentric circumferential surface extends completely around the cementing sub with an increased radius. In such an application, two or more cables may be coupled together through the concentric circumferential surface.

Figure 4:
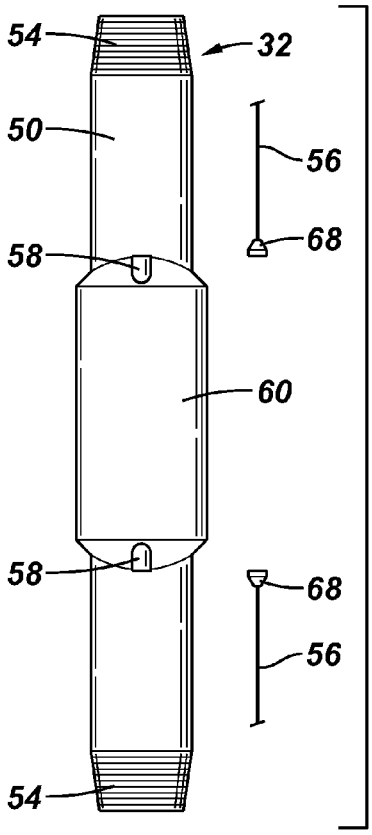
FIG. 4 is a view similar to that of FIG. 3, but showing the communication line segments disconnected, according to an embodiment of the present disclosure.

Regardless of the specific configuration of radially protruding region 60, a passageway 64 (see FIG. 3) is formed in a longitudinal direction through the radially protruding region. By way of example, passageway 64 may be drilled or machined internally to allow for completion of the communication line 40 through the radially protruding region 60 of cementing sub 32. In one example, passageway 64 surrounds a splice 66 coupled between the first and second connectors 58 to facilitate communication of signals and engagement/disengagement of the corresponding first and second cable segments 56, as illustrated in FIG. 4. As illustrated, cable segments 56 may each have a connector end 68 designed for coupling with the corresponding connector 58 of the cementing sub 32. In one embodiment, the connectors 58, 68 are dry mate connectors that may be engaged at the surface prior to deploying cementing sub 32 downhole on tubing string 28.

In some applications, the radially protruding region 60 of each cementing sub 32 is generally centered within wellbore 24 to facilitate formation of a desirable cement plug 44. In these applications, a centering device 70, such as a rigid or bow centralizer, may be mounted on cementing sub 32 to center the cementing sub within the well casing 26, as illustrated best in FIG. 2. Depending on the design of centering device 70, the device may be mounted on the cementing sub 32 and/or on cooperating tubing string components to position the cementing sub at a desired position within wellbore 24.

As tubing string 28 is deployed downhole into wellbore 24, the cementing sub 32 is connected between appropriate tubing string components 52. As discussed above, one technique for coupling the cementing sub 32 into the tubing string 28 is to provide the cementing sub 32 with coupling mechanisms 54 in the form of threaded ends. Threaded tubing connections are available and some of the suitable connections are known as VAM, Tenaris, or API connectors, although other types of threaded connections also may be employed.

As further illustrated in FIG. 2, the cementing sub 32 comprises an internal flow passage 72 that is the primary passage through which fluid flows during production, well servicing, or other applications in which fluid is directed along an interior of the tubing string 28. The flow passage 72 is generally aligned with the internal flow passage extending along the entire tubing string 28. Between the coupling mechanisms 54, flow passage 72 is defined by the internal diameter of the cementing sub 32 and may have an expanded region 74 with an increased internal diameter, as represented by dashed lines in FIG. 2. Although the internal diameter of the cementing sub 32 may be consistent with the flow passage diameter through the rest of the tubing string 28 in some applications, the expanded region 74 can be used to enable better anchoring of an internal cement plug 44 (see FIG. 1) when the well is plugged. The increased diameter region 74 may extend along a portion of cementing sub 32. It should be noted that in some embodiments, the flow passage 72 is generally parallel with the passageway 64 which extends through radially protruding region 60.

One consideration in determining a configuration of the communication line cementing sub 32 may be the number of communication lines 40 desired for connection with the cementing sub. Another consideration may be whether the cement plug 44 is able to engage the surface of the cementing sub to reduce or eliminate leak paths between the cement plug 44 and the cementing sub 32. For example, the illustrated cementing sub surface provides a relatively smooth, solid surface in a longitudinal direction along which the cement plug 44 may be formed. The outside geometry of the cementing sub 32 may be smooth to allow for efficient fluid removal around the radially protruding region 60 or other protruding regions.

Another approach to increasing the effectiveness of the cement plug 44 is to centralize the offset or protruding region 60 inside casing 26. As described above, centralizing the radially protruding region 60 may be accomplished with one or more centering devices 70. The effectiveness of each cement plug 44 also may be increased by selecting the longitudinal length of the radially protruding region 60 to best meet the requirements of the particular well and well operator. This length can vary substantially, but in some applications the length is approximately 10 feet. Increasing the number of cementing subs 32 positioned along tubing string 28 also may improve the ability to reduce or eliminate leak paths along the wellbore.

Potential leak paths also are reduced or eliminated by selecting appropriate connections between the cementing sub 32 and the communication lines 40. In one example, connector ends 68 of cable segments 56 and connectors 58 of cementing sub 32 are respectively formed as dry mate plugs and receptacles. Although dry mate connections are described with respect to a specific embodiment, other embodiments may utilize other types of connectors. In the illustrated example, the dry mate connections are made at the surface prior to running the one or more cementing subs 32 downhole into wellbore 24 (see FIG. 1).

Each connector 58, e.g., dry mate receptacle, may include a pressure feed through barrier, as described in greater detail below. The pressure feed through barrier inhibits or prevents any fluid ingress migrating along the communication line and further into the cementing sub 32. As a result, any internal leaks along the isolated passageway 64 are prevented, such that it may be referred to as substantially "leak-proof", ensuring that it remain unexposed to the surrounding wellbore 24. The nature of the material and the pressure and temperature rating of the pressure feed through barrier may be adapted to reflect the specific downhole conditions, e.g., pressure, temperature, type and composition of fluids, and other downhole parameters. Similarly, the connector 58 and the connectivity hardware are selected and configured to last over a long period of time to ensure that degradation due to corrosion or other factors provides minimal or no risk of failure.

Figure 5:
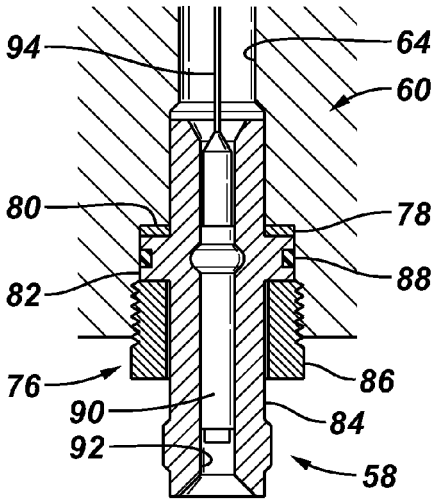
FIG. 5 is a cross-sectional view of one example of a connector by which a communication line segment is connected to the cementing sub, according to an embodiment of the present disclosure.

Referring generally to FIG. 5, a cross-sectional view of one example of a dry mate connector 58 is illustrated. In this example, connector 58 comprises a receptacle 76 mounted to radially protruding region 60 of cementing sub 32 via a reliable and long-term sealing technology. One example of a reliable and long-term sealing technology utilizes a metal ring 78, e.g., a metal O-ring, employed as the primary seal. However, other technologies, including welded connections, may be used to ensure a long lasting pressure barrier.

In the example illustrated, metal ring 78 is disposed between a step 80 (formed within radially protruding region 60) and a radially expanded portion 82 of a connector body 84. A fastening device 86, such as a threaded nut, is engaged with the radially protruding region 60 on an opposite side of expanded portion 82 of connector body 84. As fastening device 86 is tightened against expanded portion 82, the metal ring 78 is compressed to form a long lasting pressure barrier. Additionally, a pressure tested O-ring 88 may be disposed between expanded portion 82 and the surrounding wall surface of radially protruding region 60.

As illustrated, this type of connector 58 also utilizes a pressure feed through 90, such as an electrical pressure feed through, deployed in a longitudinal opening 92 extending through the interior of connector body 84. The connectors 58 on opposite longitudinal ends of radially protruding region 60 are connected by an internal communication line 94 routed through passageway 64 to engage the pressure feed through 90 of each connector 58. The internal communication line 94, in cooperation with each pressure feed through 90, effectively forms a splice for splicing the communication line segments 56 within the radially protruding region 60 of the cementing sub 32 (also see FIGS. 2-4).

Although the internal communication line 94 and associated connectors 58 have been described for use in forming an electrical connection, similar systems may be used to connect optical, hydraulic, or other types of communication lines. In some applications, only one communication line is routed through cementing sub 32, while in other cases two or more communication lines may be similarly routed/spliced through the radially protruding region 60 of cementing sub 32.

Figure 6:
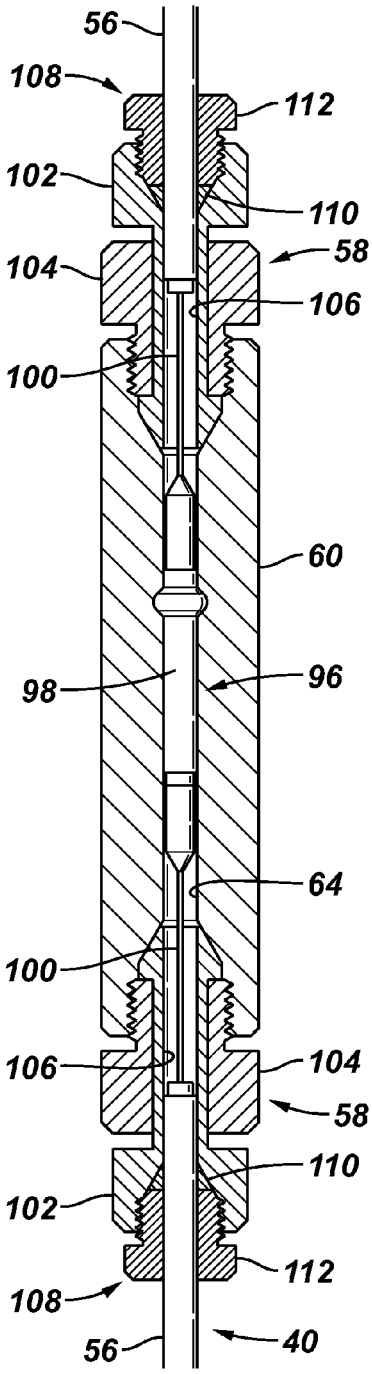
FIG. 6 is a cross-sectional view of one example of a communication line splice within the cementing sub, according to an embodiment of the present disclosure.

Referring generally to FIG. 6, an example of another type of splice system 96 is illustrated for use in splicing communication line segments through the radially protruding region 60 of cementing sub 32. The splice system 96 functions to prevent any fluid ingress or migration inside of the communication line, e.g., cable, 40. In this particular example, splice system 96 comprises a pressure feed through 98, e.g., an electrical pressure feed through, which is welded inside of passageway 64. The nature of the materials used and the pressure and temperature ratings of the barrier established are adapted to specific downhole conditions, such as pressure, temperature, type and composition of fluids, and other well related parameters. The materials and configuration of splice system 96 are selected to enable long-term survival without undue degradation due to rust, corrosion or other potential, deleterious consequences resulting from the harsh downhole environment. In this embodiment, the communication line also may be one or more of an electrical line, optical line, hydraulic line, or other types of signal carrying lines.

As illustrated in the example of FIG. 6, pressure feed through 98 may be connected between connectors 58 by suitable internal communication lines 100. Additionally, each connector 58 may comprise a suitable connector body 102 secured against an internal surface of radially protruding region 60 via a fastening device 104, such as a threaded fastening device. Each fastening device 104 may be engaged with the radially protruding region 60 to drive the corresponding connector body 102 into engagement with a corresponding internal surface of radially protruding region 60. The connector body 102 may be designed to seal against corresponding surfaces of radially protruding region 60; however the welded pressure feed through 98 ensures that no fluid migration occurs along passageway 64.

In this type of splice system, each connector body 102 also may comprise an internal longitudinal passage 106 designed to receive an end the of the corresponding communication line segment 56. Each communication line segment 56 may be sealed within the longitudinal passage 106 by a suitable engagement system 108. One example of a suitable engagement system 108 comprises one or more ferrules 110 which may be forced into engagement between the communication line segment 56 and the surrounding connector body 102 by an externally threaded nut 112 or other suitable fastener.

Although other types of connectors 58 may be employed, the embodiments described above provide examples of dry mate connectors that may be used to provide stable, long lasting communication line connections through the cementing sub 32. The connectors are not susceptible to unwanted fluid migration. Effectively, the dry mate connectors function to seal around, for example, the armor of the communication line/cable. In some examples, communication line 40 is formed as a cable with a metal armor, such as a quarter inch metal armor. The dry mate connectors are specifically designed to provide a long lasting seal, although the specific long lasting seal technology may be adjusted according to the specific application. In some applications, for example, the primary seal may be formed via a metal-to-metal seal with at least one supplemental O-ring for pressure testing during assembly and backup. (See, for example, FIG. 5). In other cases, however, connection designs may be based on welded technology utilizing connections which are solidly welded to virtually eliminate any possible leak paths. (See, for example, FIG. 6).

The overall well system 20 (FIG. 1) may be designed to accommodate a variety of cementing applications in a variety of well environments. Accordingly, the number, type and configuration of components and systems within the overall system can be adjusted to accommodate different applications. For example, the size and configuration of the cementing sub and its radially protruding region may vary. Additionally, the primary flow passage through the cementing sub and the communication line passageway may be routed according to various orientations. The number of communication line passageways through each radially protruding region also may be selected according to the number of communication lines routed down along the tubing string completion. The types of connectors and splicing systems for connecting communication line segments through the radially protruding region also may change according to the parameters of a specific application and/or environment. Similarly, the types and arrangements of components used in the tubing string may vary substantially depending on the well application for which the tubing string completion is designed. As a result, the number, size and configuration of the cement plugs also may be selected according to the number and arrangement of cementing subs for a given tubing string completion and downhole application.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few embodiments of the present disclosure have been described in detail above, those of ordinary skill in the art will readily appreciate that many modifications are possible without materially departing from the teachings of this disclosure. Accordingly, such modifications are intended to be included within the scope of this invention as defined in the claims.

What is claimed is:

1. A system for use in a well, comprising a tubing string having a communication line cementing sub to prevent fluid migration along a communication line after a cementing operation, the communication line cementing sub comprising:

a flow passage;

a radially protruding region;

an isolated passageway circumferentially formed by the radially protruding region and extending longitudinally through the radially protruding region;

a first connectors sealing the isolated passageway at a first longitudinal end of the radially protruding region;

a second connector sealing the isolated passageway at a second longitudinal end of the radially protruding region; and a splice of the communication line sealingly disposed in the isolated passageway.

2. The system as recited in claim 1, further comprising:

a first cable segment coupled to the first connector; and a second cable segment coupled to the second connector.

3. The system as recited in claim 1, further comprising a centering device to center the radially protruding region in a surrounding wellbore.

4. The system as recited in claim 1, wherein the radially protruding region protrudes eccentrically with respect to an axis of the tubing string.

5. The system as recited in claim 1, further comprising a cement plug deployed around the communication line cementing sub within a wellbore.

6. The system as recited in claim 1, wherein the communication line cementing sub is threadably engaged with adjacent components of the tubing string.

7. The system as recited in claim 1, wherein at least a portion of the flow passage in the communication line cementing sub has a larger diameter than a flow passage in adjacent components of the tubing string.

8. The system as recited in claim 1, wherein the first and second connectors are dry mate cable connectors.

9. The system as recited in claim 8, wherein a first cable segment is coupled to a second cable segment in the passageway via the splice and having a pressure feed through.

10. The system as recited in claim 1, wherein the tubing string comprises a plurality of cementing subs.

11. A well system, comprising a cable cementing sub comprising a protruding outer diameter portion along at least a portion of a length of the cable cementing sub, wherein the cable cementing sub further comprises:

an upper connection configured to couple with an upper cable;

a lower connection configured to couple with a lower cable;

an isolated passageway coupling the upper connection to the lower connection at a splice of the cables disposed therein, wherein the isolated passageway is circumferentially formed by the protruding outer diameter portion and sealed at the upper connection and the lower connection; and a centering device configured to center the protruding outer diameter portion of the cable cementing sub within a well casing and exposed to an annulus thereof.

12. The well system as recited in claim 11, wherein the protruding outer diameter portion protrudes eccentrically.

13. The well system as recited in claim 11, wherein the cable cementing sub further comprises a flow passage generally parallel with the passageway.

14. The system as recited in claim 13, wherein the flow passage has an expanded diameter along a portion of the cable cementing sub.

15. The system as recited in claim 11, wherein the upper connection and the lower connection each comprises a dry mate connector.

16. The system as recited in claim 11, further comprising a cement plug disposed around the protruding outer diameter portion.

17. A method for sealing an abandoned well, comprising:

completing a well with at least one cementing sub coupled to an upper cable and a lower cable with a splice of the cables sealingly disposed in an isolated passageway of the sub and wherein the cementing sub comprises a protruding outer diameter portion exposed to an annulus of the well, wherein the isolated passageway is circumferentially formed by the outer diameter portion and sealed at upper and lower longitudinal ends of the protruding outer diameter;

centering the cementing sub within a casing of the well; and providing at least one cement plug at a location along the length of the well corresponding to the protruding outer diameter portion.

18. The method as recited in claim 17, wherein centering comprises centering an eccentric protruding outer diameter portion.

19. The method as recited in claim 17, wherein completing comprises using the cementing sub with a flow passage; and further comprising cementing the flow passage.

* * * * *